United States Patent [19]

Springer

[11] 4,375,865

[45] Mar. 8, 1983

[54] COLOR CHANGE SYSTEM FOR SPRAY COATING APPARATUS

[75] Inventor: Carl M. Springer, Park Ridge, Ill.

[73] Assignee: Binks Manufacturing Company, Franklin Park, Ill.

[21] Appl. No.: 325,140

[22] Filed: Nov. 27, 1981

Related U.S. Application Data

[62] Division of Ser. No. 177,399, Aug. 12, 1980, Pat. No. 4,337,282.

[51] Int. Cl.[3] ..... B67D 5/60

[52] U.S. Cl. ..... 222/135; 222/145; 222/144.5; 239/112; 118/302

[58] Field of Search ..... 427/421; 118/302; 239/112, 113, 70, 120, 305, 104; 222/129, 130, 148, 136, 135, 145, 144.5

[56] References Cited

U.S. PATENT DOCUMENTS 3,145,930 8/1964 Herklotz et al. ..... 118/302
3,674,205 4/1972 Kock ..... 239/112
3,857,513 12/1974 Wiggins ..... 239/112

*Primary Examiner*—H. Grant Skaggs
*Assistant Examiner*—Kenneth Noland
*Attorney, Agent, or Firm*—Gary, Juettner & Pyle

[57] ABSTRACT

A color change system for spray coating apparatus is characterized by two pumps, each of which is connectable with a selected color of coating material for providing the same to spray coating apparatus. The arrangement is such that the pumps alternately supply different colors of coating material to the coating apparatus, and when one of the pumps is supplying material the other is being cleansed of previously supplied material. In this manner, one pump is always clean and ready for supplying a newly selected color of material, so that any number of different colors of coating material may be provided to the coating apparatus with minimum numbers of pumps, e.g., two pumps. In one embodiment the color change system is used with automatic spray coating apparatus, and in another with manual or hand held coating apparatus.

10 Claims, 7 Drawing Figures

| STEP | FUNCTION | V1 | V2 | V3 | V4 | V5 | V6 | V7 | V8 | V9 | V10 | V11 | V12 | V13 | V14 | P1 MAX | P1 MIN | P1@FLOW | P2 MAX | P2 MIN | P2@FLOW |
|---|---|---|---|---|---|---|---|---|---|---|---|---|---|---|---|---|---|---|---|---|---|
| 1 | FLUSH PHASE I (PUMP 1) | 1 | 1 | 1 | 1 | 1 | 0 | 0 | 1 | 1 | 0 | 1 | 1 | 0 | 0 | 1 | 0 | 0 | 0 | 1 | 0 |
| 2 | FLUSH PHASE II (PUMP 2) | 0 | 1 | 0 | 1 | 0 | 1 | 1 | 1 | 1 | 1 | 1 | 1 | 0 | 0 | 0 | 1 | 0 | 1 | 0 | 0 |
| 3 | COLOR FILL N (PUMP 2) | 0 | 1 | 1 | 1 | 0 | 1 | 0 | 1 | 1 | 1 | 1 | 0 | 1 | 0 | 1 | 0 | 0 | 1 | 0 | 0 |
| 4 | SPRAY FOR COLOR N | 0 | 1 | 1 | 1 | 0 | 1 | 0 | 0 | 0 | 1 | 0 | 0 | 0 | 0 | 0 | 1 | 0 | 0 | 0 | 1 |
| 5 | END OF COLOR N | 0 | 1 | 1 | 1 | 0 | 1 | 0 | 0 | 0 | 1 | 0 | 0 | 0 | 0 | 0 | 1 | 0 | 0 | 0 | 0 |
| 6 | FLUSH PHASE I (PUMP 2) | 0 | 1 | 0 | 1 | 0 | 1 | 1 | 1 | 1 | 1 | 1 | 1 | 0 | 0 | 0 | 1 | 0 | 1 | 0 | 0 |
| 7 | FLUSH PHASE II (PUMP 1) | 1 | 1 | 1 | 1 | 1 | 0 | 0 | 1 | 1 | 0 | 1 | 1 | 0 | 0 | 1 | 0 | 0 | 0 | 1 | 0 |
| 8 | FILL COLOR N+1 (PUMP 1) | 1 | 1 | 0 | 1 | 1 | 0 | 1 | 1 | 1 | 0 | 1 | 0 | 0 | 1 | 1 | 0 | 0 | 1 | 0 | 0 |
| 9 | SPRAY FOR COLOR N+1 | 1 | 0 | 0 | 0 | 1 | 0 | 1 | 1 | 1 | 0 | 0 | 0 | 0 | 0 | 0 | 0 | 1 | 0 | 1 | 0 |
| 10 | END OF COLOR N+1 | 1 | 0 | 0 | 0 | 1 | 0 | 1 | 1 | 1 | 0 | 0 | 0 | 0 | 0 | 0 | 0 | 0 | 0 | 1 | 0 |
| 11 | FLUSH PHASE I (PUMP 1) | 1 | 1 | 1 | 1 | 1 | 0 | 0 | 1 | 1 | 0 | 1 | 1 | 0 | 0 | 1 | 0 | 0 | 0 | 1 | 0 |
| 12 | FLUSH PHASE II (PUMP 2) | 0 | 1 | 0 | 1 | 0 | 1 | 1 | 1 | 1 | 1 | 1 | 1 | 0 | 0 | 0 | 1 | 0 | 1 | 0 | 0 |
| 13 | FILL COLOR N+2 (PUMP 2) | 0 | 1 | 1 | 1 | 0 | 1 | 0 | 1 | 1 | 1 | 1 | 0 | 1 | 0 | 1 | 0 | 0 | 1 | 0 | 0 |
| 14 | ETC | | | | | | | | | | | | | | | | | | | | |

"1" ACTIVE OR VALVE OPEN
"0" INACTIVE OR VALVE CLOSED

Fig. 3.

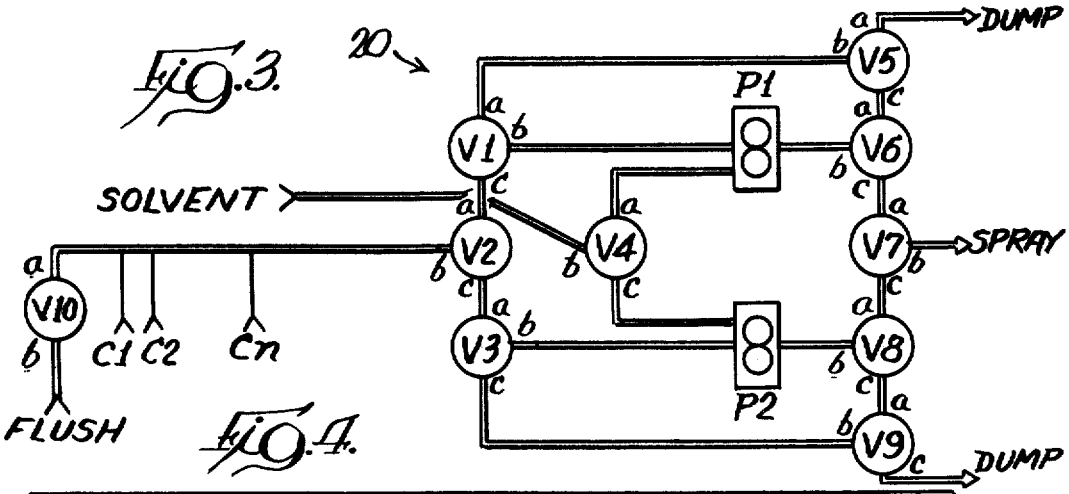

Fig. 4.

| STEP | FUNCTION | V1 | V2 | V3 | V4 | V5 | V6 | V7 | V8 | V9 | V10 | P1 MAX | P1 MIN | P1@FLOW | P2 MAX | P2 MIN | P2@FLOW |
|---|---|---|---|---|---|---|---|---|---|---|---|---|---|---|---|---|---|
| 1 | FLUSH PHASE I (PUMP 1) | a b c | a b | a b c | a b | b c | a b c | a b | a b c | a b | a b | 1 | 0 | 0 | 0 | 1 | 0 |
| 2 | FLUSH PHASE II (PUMP 2) | a b c | b c | a b c | b c | b c | a b c | b c | a b c | a b | a b | 0 | 1 | 0 | 1 | 0 | 0 |
| 3 | FILL COLOR N (PUMP 2) | a b c | b c | a b c | a b | a b c | a b c | b c | a b c | a b | – | 1 | 0 | 0 | 1 | 0 | 0 |
| 4 | SPRAY COLOR N (PUMP 2) | a b c | b c | a b | a b | b c | a b c | b c | a b | a b | – | 0 | 1 | 0 | 0 | 0 | 1 |
| 5 | END OF COLOR N (PUMP 2) | a b c | b c | a b | a b | b c | a b c | b c | a b | a b | – | 0 | 1 | 0 | 0 | 0 | 0 |
| 6 | FLUSH PHASE I (PUMP 2) | a b c | b c | a b c | b c | b c | a b c | b c | a b c | a b | a b | 0 | 1 | 0 | 1 | 0 | 0 |
| 7 | FLUSH PHASE II (PUMP 1) | a b c | a b | a b c | a b | b c | a b c | a b | a b c | a b | a b | 1 | 0 | 0 | 0 | 1 | 0 |
| 8 | FILL COLOR N+1 (PUMP 1) | a b c | a b | a b c | b c | b c | a b c | a b | a b c | a b c | – | 1 | 0 | 0 | 1 | 0 | 0 |
| 9 | SPRAY COLOR N+1 (PUMP 1) | b c | a b | a b c | b c | b c | b c | a b | a b c | a b | – | 0 | 0 | 1 | 0 | 1 | 0 |
| 10 | END OF COLOR N+1 (PUMP 1) | b c | a b | a b c | b c | b c | b c | a b | a b c | a b | – | 0 | 0 | 0 | 0 | 1 | 0 |
| 11 | FLUSH PHASE I (PUMP 1) | a b c | a b | a b c | a b | b c | a b c | a b | a b c | a b | a b | 1 | 0 | 0 | 0 | 1 | 0 |
| 12 | FLUSH PHASE II (PUMP 2) | a b c | b c | a b c | b c | b c | a b c | b c | a b c | a b | a b | 0 | 1 | 0 | 1 | 0 | 0 |
| 13 | FILL COLOR N+2 (PUMP 2) | a b c | b c | a b c | a b | a b c | a b c | b c | a b c | a b | – | 1 | 0 | 0 | 1 | 0 | 0 |
| 14 | ETC | | | | | | | | | | | | | | | | |

LETTERS REPRESENT VALVE CONNECTIONS ESTABLISHED
"1" PUMP ACTIVE
"0" PUMP INACTIVE

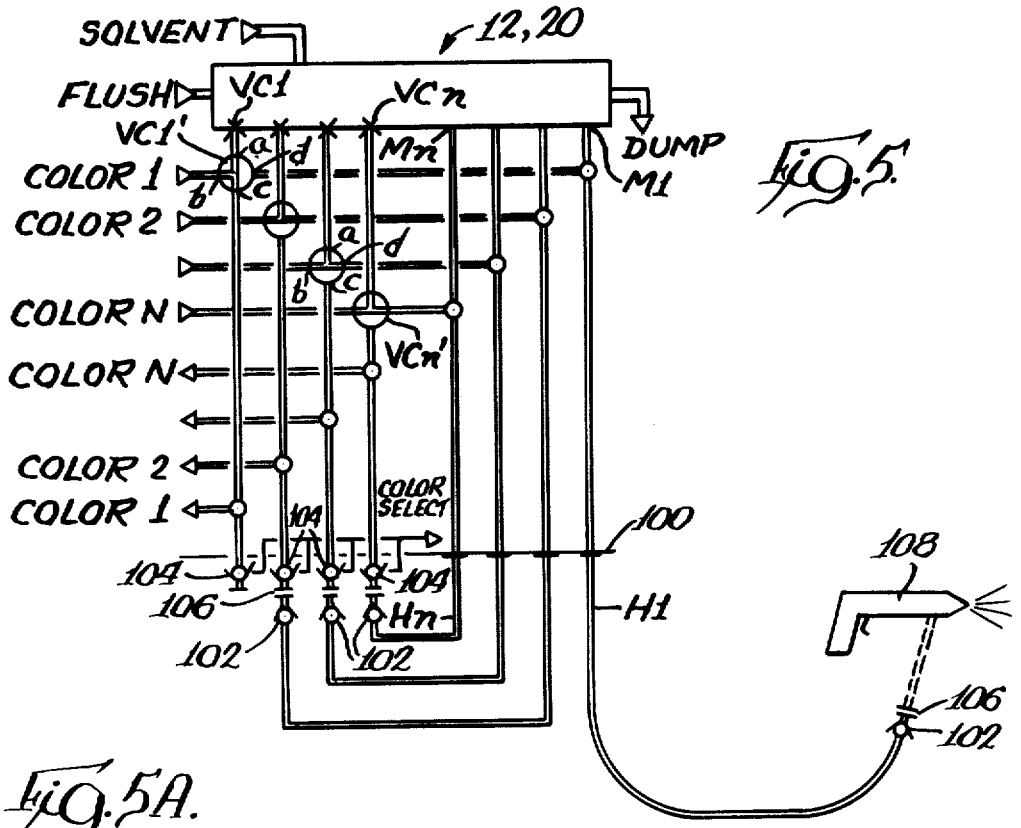
Fig.5.
Fig.5A.
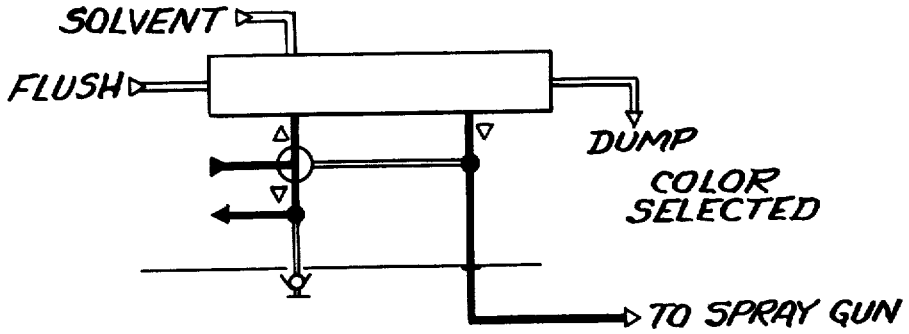
Fig.5B.
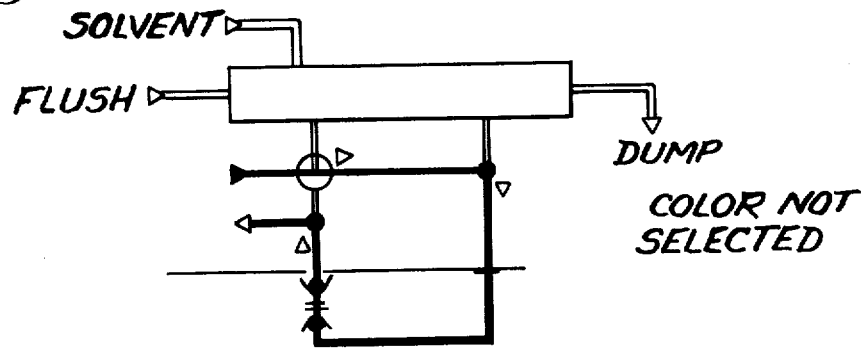

COLOR CHANGE SYSTEM FOR SPRAY COATING APPARATUS

This is a division, of application Ser. No. 177,399 filed Aug. 12, 1980, now U.S. Pat. No. 4,337,282.

BACKGROUND OF THE INVENTION

The present invention relates to color change systems for spray coating apparatus, and in particular to improved color change systems for rapidly changing from spraying coating material of one color to spraying material of another color.

Color change systems for spray coating apparatus have particular application in industrial operations where articles or ware are to be spray coated at a spray station, or are to be coated as they move along a production line. Where the articles are required to be coated a wide variety of colors, it is generally not practical to establish separate spray stations or production lines for each color, or even to spray a long sequence of articles of one color, then another long sequence of articles of a second color, etc. Instead, it is desirable to be able to make color changes rapidly and simply at a single spray station.

Color change systems are useful in such cases, and provide for a variety of colors to be sprayed from a single spray gun. With many conventional systems, a plurality of supply containers of fluid, each of a different color and having a separate motor driven fluid pump, are connected with a manifold through valve controlled ports. An outlet from the manifold connects with an inlet to the spray gun, and to spray material of a particular color the port valve associated therewith is opened and the motor driven pump for the supply is energized to provide the fluid through the manifold to the gun. After completion of spraying coating material of a particular color, the manifold and gun are flushed with solvent and compressed air to clean the system in preparation for spraying material of a different color.

Although the foregoing types of color change systems provide versatility in spraying a plurality of different colored fluids with a single spray gun, they suffer the disadvantage of requiring a separate motor driven pump for each supply container of fluid, and are therefore expensive because of the large numbers of pumps involved. For limited use on small production lines, their costs often cannot be justified. In addition, requisite manifold flushing between color changes imposes time limitations on the color change process, which limitations may become significant in use of high solids paints which do not flush rapidly. Consequently, such systems also lack versatility for use with production lines in which rapid color changes are necessary.

One prior effort to minimize the costs of color change systems of the aforementioned type contemplates use of a single motor driven pump at the outlet from the manifold, instead of separate motor driven pumps for each supply container of fluid. In this case, lines extend between the valve controlled ports of the manifold and the supply containers, whereby fluid of a selected color may be connected through the manifold with the pump for delivery to the spray gun. Although use of a single motor driven pump significantly decreases system cost, the pump along with the manifold must be cleansed between color changes, so that this type of system also suffers from significant time delays between color changes, particularly in use of high solids paints, which are increasingly being turned to because of decreased environmental pollution incident to their use.

OBJECTS OF THE INVENTION

An object of the present invention is to provide an improved and economical system for selectively spray coating a plurality of different colored materials, and for simply and quickly changing from material of one color to material of another color.

Another object of the invention is to provide an improved and economical system for selectively spray coating a plurality of different colored materials, using a pair of motor driven pumps which are alternately connectable with selected ones of the materials and in which one of the pumps is cleansed of coating material while the other is pumping material, and vice versa.

SUMMARY OF THE INVENTION

In accordance with the present invention, a color change system for supplying selected colors of coating materials to coating apparatus comprises a pair of pumps, each for providing coating material to the apparatus. Means are included for selectively and alternately connecting inlets to said pumps with supplies of coating material and solvent for the coating material, such that said pumps alternately provide different colors of coating material to the apparatus, and such that when one of the pumps provides coating material the other pump is connected with the solvent for being cleansed of previously provided coating material.

In accordance with a method of the invention for supplying selected colors of coating materials to coating apparatus with a pair of pumps, individual ones of the pump inlets are alternately connected with selected ones of the supplies of coating material and the pump outlets are alternately connected with the coating apparatus, such that only one pump at a time provides coating material to the apparatus. Also, while one of the pumps is providing coating material, the inlet to the other pump is connected with a supply of solvent for the coating material to clean the pump of previously provided coating material.

The invention thus provides an improved color change system and method for coating apparatus. By virtue of only one pump at a time providing coating material to the coating apparatus while the other is being cleaned, minimum numbers of pumps are required to accomplish color change functions, whereby the structure of the system is relatively simplified and economical.

The foregoing and other objects, advantages and features of the invention will become apparent upon a consideration of the following detailed description, when taken in conjunction with the accompanying drawings.

BRIEF DESCRIPTION OF THE DRAWINGS

FIG. 3 is a schematic representation of a color change system for spray coating apparatus in accordance with another embodiment of the invention;

FIG. 4 is a truth table, showing one contemplated mode of operation of the system of FIG. 3;

FIG. 5 illustrates partly in schematic and partly in block diagram form an arrangement of color change system for use with a hand held spray gun at a spray booth in accordance with a further embodiment of the invention; and FIGS. 5A and 5B show the directions of material flow in the system of FIG. 5 for material which has been selected for spraying and for material which has not.

DETAILED DESCRIPTION

Figures 1, 2:
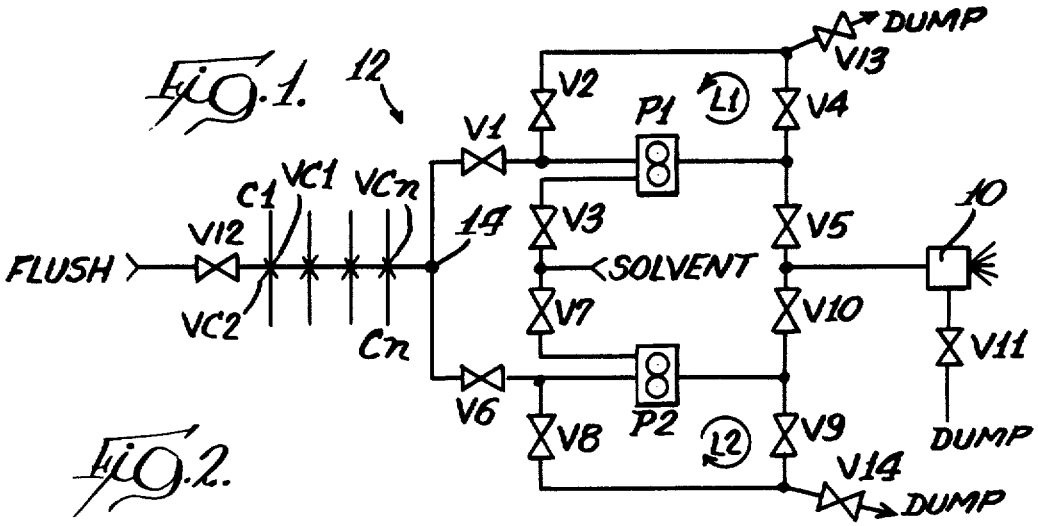
FIG. 1 is a schematic representation of a color change system for spray coating apparatus in accordance with one embodiment of the present invention.
FIG. 2 is a truth table, showing one contemplated mode of operation of the color change system in FIG. 1.

FIG. 1 schematically shows a spray gun 10 adapted to be supplied with and to spray any one of a plurality of materials or fluids. There is also shown one embodiment of color change system, indicated generally at 12, for selectively supplying any one of a number of different colored materials Cn to the gun, which are representative of a large number of materials that can be supplied. The color change system includes a pair of motor driven pumps P1 and P2, and a plurality of two-way valves V1–V14 which are operable to provide material of selected colors to the spray gun through the pumps and/or flushing fluids to the pumps, such that the pumps alternately supply different colored materials to the gun, with one of the pumps supplying material of one color while the other is cleansed of previously supplied fluid, and vice versa.

Specifically, lines extending to separate supply containers (not shown) of different colored fluids C1–Cn may be selectively coupled with an inlet 14 to the color change system through associated valves VC1–VCn. Valves V1 and V6 are between the system inlet and first inlets to respective ones of the pumps P1 and P2, which preferably are motor driven gear pumps for accuracy and controllability in dosing, and valves V3 and V7 are between a supply of solvent and second inlets to respective ones of the pumps, the first and second inlets communicating with common inlet chambers in the respective pumps. A pair of valves V2 and V4 are in series in a loop L1 between an outlet from and the first inlet to the pump P1, a pair of valves V8 and V9 are in series in a loop L2 between the outlet from and the first inlet to the pump P2, and dump valves V13 and V14 connect with respective junctures of the valves V2 and V4 and the valves V8 and V9. Valves V5 and V10 are operable to connect an outlet from a selected one of the pumps P1 and P2 with the spray gun 10, and a dump valve V11 connects with the spray gun material line at a point just prior to a material valve thereof, the material valve being of a conventional type as is known in the art and operable to emit in a spray from the gun material supplied by either the pump P1 or P2 through the valve V5 or V10. The inlet 14 to the color change system is also connected with a supply of flushing media through a valve V12, the flushing media comprising alternate applications of compressed air and a flush fluid for the coating material.

Considering operation of the color change system in relatively general terms, the valves V1–V14 along with the pumps P1 and P2 are operable either manually or by any suitable automatic control in a manner so that only one of the pumps P1 and P2 supplies coating material at any one time to the spray gun, with the other pump at that time being cleansed in preparation for supplying a subsequent and different color of coating material. To change color of coating material, the valves and pumps are operated so that the pump which was previously cleaned supplies the new color of material to the spray gun, while at the same time the other pump is flushed clean in preparation for supplying the next subsequent color of material.

For the case where the pump P1 supplies coating material to the gun, the material passes from one of the valves VC1–VCn through the valves V1 and V5 and the pump P1 to the gun, with the valves V2 and V4 then being closed. At the same time, with the valves V6 and V10 closed and the valves V7–V9 open, the pump P2 recirculates a cleaning solution between its outlet and inlet through the loop L2 for cleaning the same of previously pumped coating material. For the situation where the pump P2 provides material to the gun, the material passes from one of the valves VC1–VCn through the valves V6 and V10 and the pump P2 to the gun, with the valves V8 and V9 then being closed. At the same time, the valves V1 and V5 are closed and the valves V2–V4 are open, and the pump P1 recirculates a cleaning solution between its outlet and its inlet through the loop L1 for cleaning the same of previously pumped coating material. The pumps P1 and P2 are controllable both in operation and speed of operation and where the same are gear pumps, for long life the recirculating cleaning solution or solvent advantageously includes a gear lubricant, for example a mixture of a gear lubricant and a flushing fluid for the material. Between color changes, flushing media introduced through the valve V12 quickly removes excess coating material and/or solvent from the color change system.

The arrangement and mode of operation of the color change system enables any number of different colored materials to be readily supplied to the spray gun with minimum numbers of pumps, e.g., two pumps. By virtue of one pump being cleaned while the other supplies material to the gun, changing the color of material is accomplished very rapidly. Simply, material of the new color is provided through the previously cleaned pump to the gun, while at the same time the other pump is cleaned in preparation for the next color change. Obviously, should color changes be required at frequencies that do not afford sufficient time for cleaning a single pump between changes, or if the time required for cleaning coating material from a pump is greater than the intervals between color changes, more than two pumps may be used, for example three or four. In such case, the pumps would sequentially provide different colored materials to the gun, such that one pump supplied material while the others were being cleaned, thereby increasing the time available for cleaning a pump before it again delivers material to the gun.

Considering the color change system of FIG. 1 in greater detail, and with reference to the truth table of FIG. 2 for operation of the system, assume an idle condition in which solvent is recirculated by the pumps P1 and P2 through the loops L1 and L2 to cleanse the same of previously pumped coating materials. During an initial step which clears the system of the recirculated solvent, flush and solvent are introduced to the pump P1 to clear the pump, the loop L1 and the line to the material valve of the spray gun 10 of previously recirculated solvent. At this time, the pump P1 is operated at a maximum rate to speed the flow of solvent and flush therethrough, and the pump P2 at a minimum rate to continue to recirculate solvent through the loop L2. In a following step 2, the pump P1 is then operated at a minimum rate to move flush and solvent through the loop L1, and flush and solvent are introduced to the pump P2 to clear the pump, the loop L2 and the line leading to the material valve of the spray gun of previously recirculated solvent.

To prepare the system for spraying a material of color N, a selected one of the valves VC1–VCn is opened and, during a step 3, material is introduced to the pump P2 while the pump is operated at a maximum rate to speed flow of material to the spray gun. At the same time, solvent is introduced to the pump P1 and the dump valve V13 opened to remove from the pump and the loop L1 the mixture of flush and solvent and to fill the same with a fresh mixture of solvent for recirculation during the time that material is sprayed. The dump valve V11 remains open until material supplied by the pump P2 reaches the material valve of the gun, whereupon the dump valve is closed for spraying material during a step 4. During spraying, the pump P1 operates at a minimum rate to recirculate solvent through the loop L1, and the pump P2 at a flow rate determined by the rate at which material is to be supplied to the gun and until completion of spraying, whereupon in a step 5 the pump P2 is turned off.

To prepare the system for spraying a next subsequent color of material N+1 and to cleanse the same of previously sprayed material to color N, in a step 6 solvent and flush are introduced to the pump P2 while the same is operated at a maximum rate and the dump valve V11 opened to remove from the pump and its associated valves and lines the majority of the material of color N. Then, in a step 7 flush and solvent are introduced to the pump P1 to clean the pump and its associated lines and valves of previously recirculated solvent, and in step 8 a selected one of the material valves VC1–VCn is opened to introduce material of the color N+1 to the pump P1 while the pump P2 and its associated loop L2 are filled with solvent. During step 9 material of color N+1 is sprayed, while the pump P2 is simultaneously cleansed by recirculating solvent of any remaining material of color N.

During spraying of material of the color N+1, the pump P1 operates at a flow rate determined by the rate at which material is to be supplied to the spray gun and the pump P2 at a minimum rate to recirculate solvent through the loop L2. Upon completion of spraying material of the color N+1, in a step 10 the pump P1 is turned off, and in a step 11 flush and solvent are introduced to the pump P1 and the dump valve V11 is opened to remove from the pump and its associated valves and lines a majority of material of the color N+1. Thereafter, in a step 12 flush and solvent are introduced to the pump P2 to clear the same of previously recirculated solvent, and in a step 13 the system is prepared to supply the next subsequent material of color N+2, whereupon cyclical system operation continues as above described.

The embodiment of invention in FIG. 1 thus provides improvements in color change systems for spray coating apparatus. By virtue of one of the pumps P1 and P2 being cleaned while the other supplies coating material to the spray gun, large numbers of different colored coating materials may be accommodated by the system without use of a separate pump for each different color of material. At the same time, the system accommodates color changes at a rate considerably faster than may be accomplished with prior systems of the type using a single pump which is cleansed between color changes, particularly in use of high solids paints which ordinarily cannot be rapidly flushed from a pump.

FIG. 3 illustrates an alternate embodiment of color change system, indicated generally at 20, of a type generally along the lines of that illustrated and described in respect of FIG. 1. The primary difference between the color change systems of FIGS. 3 and 1 resides in use of a combination of three-way valves, which minimize the number of valves required and somewhat simplify the system. Although not shown, it is understood that a spray gun having a dump valve at an inlet to a material valve thereof connects with an outlet b from the valve V7 in FIG. 3, much as the spray gun 10 connects with the juncture between the valves V5 and V10 in FIG. 1.

Operation of the color change system of FIG. 3 is substantially the same as that of FIG. 1, and will therefore not be described in detail. However, suffice it to say that the operation includes alternate use of two pumps P1 and P2 for supplying coating material to a spray coating apparatus. One of the pumps is cleansed of a previously supplied color of material while the other provides a newly selected color, and supplies of solvent and flush are connectable with the pumps for purging the same and their associated valves and lines of coating material and/or solvent. Reference is made to the truth table in FIG. 4 for specific details of operation of the color change system of FIG. 3.

The color change systems 12 and 20 illustrated in FIGS. 1 and 3 are particularly adapted for automatic spray painting operations wherein both the systems and the spray painting apparatus are under automatic control, for example in production lines where articles are required to be coated a wide variety of colors. However, the systems may also be readily adapted to manual spray painting operations, and FIG. 5 illustrates such an arrangement. In this case, a color change system 12 or 20 is shown as a block, and includes solvent and flush inlets as well as a dump outlet. As compared with the systems of FIGS. 1 and 3, only a single dump outlet is illustrated, it being understood that the same would be common to outlets of the valves V13 and V14 in use of a system 12 of FIG. 1, or the outlets a and c of the respective valves V5 and V9 in use of a system 20 of FIG. 3.

Assuming that the color change system is of the type shown in FIG. 1, the apparatus of FIG. 5 also includes a plurality of material valves VC1–VCn, each of which connects with a port a of an associated control valve VC1′–VCn′. A port b of each valve VC1′–VCn′ connects with an associated supply container of material of a particular color, and an outlet distribution manifold (not shown) has an inlet connected with the color change system outlet (with the juncture between the valves V5 and V10), a plurality of material outlets having material outlet valves M1–Mn and a flush outlet connected with the dump outlet. A port c of each valve VC1′–VCn′ connects with a material return line to the respective material container with which the port b of the valve connects, and a port d of each valve connects with an associated one of the manifold outlet valves M1–Mn.

The port d of each valve VC1′–VCn′ and its respective manifold outlet valve M1–Mn are each connected with one end of an associated hose H1–Hn at a material distribution panel 100 of a spray booth, a check valve 102 is at an opposite end of each hose, and the port c of each valve VC1′–VCn′ is also coupled with an associated check valve 104 at the distribution panel. Normally, the end of each hose H1–Hn, which includes the check valve 102, is connected through a releasable coupler 106 and an associated check valve 104 with the return line to its associated material container, the couplers opening the associated check valves 102 and 104 upon the mating portions of the couplers being joined. However, each coupler is releasable from its connection with its material return line for coupling the hose with a hand held spray gun 108, which closes the associated check valve 104 but opens the check valve 102 upon connection with the spray gun.

In a quiescent condition of the apparatus without connection to the spray gun, the material valves VC1–VCn and the manifold outlet valves M1–Mn are closed, the hoses H1–Hn are coupled with their associated material return lines through the couplers 106, and the valves VC1'–VCn' are in a condition such that the ports a, b and d are connected. To this end, for manual spray paint operation each material supply has an associated, relatively inexpensive pump for moving material from the supply and to the port b of its associated valve VC1'–VCn', so that for the described condition, and as shown in FIG. 5B, each material is recirculated from its supply container, through its associated valve VC1'–VCn' and hose H1–Hn, and back to its supply container through the material return line. Thus, when material is not being sprayed, it is continuously circulated to prevent it from settling or hardening within the system.

To spray a selected color of material, the appropriate valve VC1'–VCn' is operated to connect its ports a, b and c, the respective material valve VC1–VCn and manifold outlet valve M1–Mn are opened and the color change system 12 is operated as described in respect of FIG. 1 to supply material to the manifold inlet. At the same time, the hose H1–Hn for the selected material is disconnected from its check valve 104 and coupled with the spray gun 108, whereupon the material may be discharged in a spray from the gun. Note that during the time a material is being sprayed, and as shown in FIG. 5A, a path is also established between the port c of the respective valve VC1'–VCn' and the material return line for continuous circulation of material in the supply container, whereby the same does not settle. Upon completion of spraying, the hose is uncoupled from the spray gun and recoupled with its associated check valve 104, the respective valve VC1'–VCn' is placed in the position connecting the ports a, b and d, and the previously opened material valve VC1–VCn and manifold outlet valve M1–Mn are closed, whereupon the system is returned to its quiescent state in preparation for spraying material of the next selected color. It is understood, of course, that upon switching from spraying material of one color to spraying material of another, the color change system 12 is cycled as described in connection with FIG. 1, thereby preparing the system for pumping the new material through whichever pump P1 and P2 was cleaned during spraying of the previous material.

The invention thus provides improved embodiments of color change systems for spray coating apparatus, which require minimum numbers of pumps for dosing any number of differently colored coating materials. The systems may be rapidly changed from spraying material of one color to spraying material of another, and are economical in structure and readily adapted to automatic operation, although the same may also advantageously be used in manual spray paint operations.

While embodiments of the invention have been described in detail, it is understood that various modifications and other embodiments thereof may be devised by one skilled in the art without departing from the spirit and scope of the invention, as defined in the appended claims.

What is claimed is:

1. A color change system for supplying selected colors of coating materials to coating apparatus, comprising a pair of pumps each for providing coating material to the coating apparatus; and means for selectively and alternately connecting inlets to said pumps with supplies of coating material and solvent for the coating material, such that said pumps alternately provide different colors of coating material to the coating apparatus, and such that when one of said pumps provides coating material the other pump is connected with the solvent for continuously being cleansed of previously provided coating material for as long as said one pump is providing coating material.

2. A color change system as in claim 1, wherein said means for selectively and alternately connecting comprises valve means.

3. A color change system for supplying selected colors of coating materials to coating apparatus, comprising a pair of pumps each for providing coating material to the coating apparatus; and means for selectively and alternately connecting inlets to said pumps with supplies of coating material and solvent for the coating material, such that said pumps alternately provide different colors of coating material to the coating apparatus, and such that when one of said pumps provides coating material the other pump is connected with the solvent for being cleansed of previously provided coating material, wherein said means for selectively and alternately connecting includes means associated with each said pump for selectively establishing a path for recirculation of solvent between an outlet from and the inlet to the pump, and for connecting the supply of solvent with said path to introduce solvent therein when the other pump is connected with coating material.

4. A color change system as in claim 1, wherein each said pump is a gear pump for accurate dosing of coating material.

5. A color change system for supplying colors of coating materials to coating apparatus, comprising a material inlet to said system for connection with supplies of coating materials of selected colors; a material outlet from said system for connection with the coating apparatus; at least two pumps, each having an inlet and an outlet; means for cyclically and sequentially connecting individual ones of said pump inlets and outlets with said system material inlet and outlet, respectively, so that only one pump at a time provides a selected color of coating material to the coating apparatus; and means for connecting said pump inlets with a supply of solvent for the coating material when the same are not connected with the system inlet for receiving coating material, whereby only one pump at a time provides coating material while the other pumps are connected with solvent for continuously being cleansed of previously supplied coating material for as long as the one pump is providing coating material.

6. A color change system for supplying selected colors of coating materials to coating apparatus, comprising a material inlet to said system for connection with supplies of coating materials of selected colors; a material outlet from said system for connection with the coating apparatus; at least two pumps, each having an inlet and an outlet; means for cyclically and sequentially connecting individual ones of said pump inlets and outlets with said system material inlet and outlet, respectively, so that only one pump at a time provides a selected color of coating material to the coating apparatus; and means for connecting said pump inlets with a supply of solvent for the coating material when the same are not connected with the system inlet for receiving coating material, whereby only one pump at a time provides coating material while the other pumps are connected with solvent for being cleansed of previously supplied coating material, wherein said means for connecting said pump inlets with the supply of solvent includes means associated with each of said pumps for selectively establishing a path for recirculation of solvent between the outlet from and the inlet to the pump, and for connecting the supply of solvent with the path to introduce solvent therein when the pump is not connected with said system inlet for receiving coating material.

7. A system as in claim 6, including means for selectively connecting said system inlet with a supply of flushing medium for the coating material and/or solvent for rapidly cleaning said system and the pump which previously provided one color of coating material of the majority of the coating material before said pump is connected with the supply of solvent, and for rapidly cleaning the next successive pump to provide the next color of coating material of the majority of the recirculated solvent before said pump provides the next color of coating material.

8. A system as in claim 7, including means associated with each of said paths for selectively venting the same to facilitate admission of solvent therein after the pump associated therewith is finished providing coating material and has been cleared of the majority of the coating material by the flushing medium.

9. A color change system for supplying selected colors of coating materials to coating apparatus, comprising a material inlet to said system for connection with supplies of coating materials of selected colors; a material outlet from said system for connection with the coating apparatus; at least two pumps, each having an inlet and an outlet; means for cyclically and sequentially connecting individual ones of said pump inlets and outlets with said system material inlet and outlet, respectively, so that only one pump at a time provides a selected color of coating material to the coating apparatus; and means for connecting said pump inlets with a supply of solvent for the coating material when the same are not connected with the system inlet for receiving coating material, whereby only one pump at a time provides coating material while the other pumps are connected with solvent for being cleansed of previously supplied coating material, wherein the supplies of coating material are each of the type including an outlet line, a return line and a material supply pump for moving coating material from the supply and through the outlet line, said color change system further including means for connecting associated material supply outlet and return lines for continuous flow of coating material therethrough and through the material supplies irrespective of whether the coating materials are or are not connected with said system material inlet, thereby to continuously agitate the materials and prevent settling thereof.

10. A color change system as in claim 9, including a plurality of connected system material outlets, equal in number to the number of different colors of coating materials connectable with said system; a plurality of material control valves, each connectable with a respective coating material supply outlet line and return line, and with the system material inlet and an associated one of the system material outlets; and a coating material supply line for each said system material outlet, each said supply line being connected at one end with its associated system material outlet and being selectively connectable at an opposite end with the coating apparatus when the associated color of coating material is to be provided to the coating apparatus or to the associated material supply return line when the associated color of material is not to be provided to the coating apparatus, each said material control valve being operable to connect its associated coating material supply outlet and return lines and system inlet when the respective coating material is to be provided to the coating apparatus, and to connect its associated coating material supply outlet line and system outlet when the respective coating material is not to be provided to the coating apparatus.

* * * * *